US007178460B2

(12) United States Patent
Markert

(10) Patent No.: US 7,178,460 B2
(45) Date of Patent: Feb. 20, 2007

(54) WEB-FED ROTARY PRINTING PRESS

(75) Inventor: Nikolaus Markert, Triefenstein (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/490,734

(22) PCT Filed: Aug. 13, 2002

(86) PCT No.: PCT/DE02/02978

§ 371 (c)(1),
(2), (4) Date: Apr. 8, 2004

(87) PCT Pub. No.: WO03/033264

PCT Pub. Date: Apr. 24, 2003

(65) Prior Publication Data

US 2005/0076799 A1 Apr. 14, 2005

(30) Foreign Application Priority Data

Oct. 10, 2001 (DE) ..... 101 50 081

(51) Int. Cl.
*B41F 5/16* (2006.01)

(52) U.S. Cl. ..... 101/182; 101/179

(58) Field of Classification Search ..... 101/182, 101/178, 179, 174, 171, 135–140, 219–221
See application file for complete search history.

(56) References Cited

U.S. PATENT DOCUMENTS

| | | | | |
|---|---|---|---|---|
| 4,281,595 | A * | 8/1981 | Fujishiro | 101/177 |
| 4,488,483 | A * | 12/1984 | Kohara | 101/178 |
| 5,699,735 | A | 12/1997 | Stein et al. | |
| 5,816,157 | A * | 10/1998 | Gertsch et al. | 101/247 |
| 6,019,039 | A | 2/2000 | Knauer et al. | |
| 6,032,579 | A | 3/2000 | Richards | |
| 6,050,185 | A | 4/2000 | Richards | |
| 6,374,731 | B1 * | 4/2002 | Walczak et al. | 101/142 |
| 6,510,791 | B1 * | 1/2003 | Hillebrand et al. | 101/231 |
| 6,651,556 | B2 * | 11/2003 | Richards | 101/178 |

FOREIGN PATENT DOCUMENTS

| | | | |
|---|---|---|---|
| DE | 44 35 429 | A1 | 11/1996 |
| DE | 196 03 663 | A1 | 8/1997 |
| DE | 44 03 904 | C2 | 9/1997 |
| DE | 198 15 294 | A1 | 10/1998 |
| DE | 101 05 926 | A1 | 8/2002 |
| EP | 0 710 558 | A1 | 5/1996 |
| EP | 0 862 999 | A2 | 9/1998 |
| EP | 0 710 558 | B1 | 8/1999 |
| GB | 2 190 330 | A | 11/1987 |
| GB | 2 275 019 | A | 8/1994 |
| GB | 2 309 668 | A | 8/1997 |

* cited by examiner

*Primary Examiner*—Anthony H. Nguyen
(74) *Attorney, Agent, or Firm*—Jones, Tullar & Cooper, PC

(57) ABSTRACT

A web-fed rotary printing press, which is used for printing a web has at least four printing points or locations that are allocated to the web in an imprinting mode of the press. At least one of each two printing points or locations can be alternatively engaged with the web. These two printing points apply the same ink to the same side of the web. These two printing points or locations are situated in two different printing units. In each of the operating modes of the press, at least one of the printing points or locations in each of the units is in a print-on position.

17 Claims, 3 Drawing Sheets

WEB-FED ROTARY PRINTING PRESS

FIELD OF THE INVENTION

The present invention is directed to a web-fed rotary printing press. The printing press includes at least two printing units, each of which has a plurality of printing positions.

BACKGROUND OF THE INVENTION

A web-fed rotary printing press in satellite construction is known from EP 0 710 558 B1. Each of both sides of a paper web successively passes through eight printing positions, so that the web passes through 16 printing positions. The web passes successively through the two printing towers in a 4/4 paper guidance, and each printing tower can be engaged or disengaged as a unit for the purpose of imprinter functionality.

DE 43 03 904 C2 shows several arrangements of two printing groups placed on top of each other. A paper web passing through the two printing groups can be imprinted on both sides in at most four colors.

DE 196 03 663 A1 shows two H-printing units arranged one behind the other in the running direction of the web. The web, as a whole, can be imprinted on both sides. Forme cylinders on one side can be disengaged for flying plate changes.

In the later published DE 101 05 926 A1, a web is conducted through two units, each unit being provided with eight printing positions. In each one of the modes of operation of a flying plate change, at least one printing position of each unit is in a print-on position. The printing groups, which are imprinting the same color on the same side of the web, are located in the same unit.

SUMMARY OF THE INVENTION

The object of the present invention is directed to providing a web-fed rotary printing press which, for all modes of operation in four-color imprinting operations, or in four-color operation with flying plate changes, assures as even and uniform operating conditions as possible.

In accordance with the present invention, this object is attained by the provision of a web-fed rotary printing press for imprinting a web as the web passes through at least two units. The units contain at least four printing positions and the two units may be horizontally offset. The at least four printing positions are formed into groups of two printing positions. The same colors can be applied to the same side of the web in a first operating mode by a group of printing positions in the first unit and, in a second operating mode, by a group of printing positions in the second unit. In both of the operating modes, at least one group of printing positions is in the print-on position in each of the two units.

The advantages which can be gained by the invention consist, in particular, in that the print quality, in case of a change of the operating modes in multi-color imprinter operations, in particular, is increased, without an increased outlay, for the refitting of an existing printing press, being necessary.

In contrast to alternatingly switching an entire printing tower on or off, more even conditions are being provided, as a whole, along the processing path. For example, the most even moistening possible of the web of material, i.e. the paper web, is achieved by the use of the web-fed rotary printing press of the present invention. It is avoided that, for example in the first operating mode of a so-called 4/4+4/4 paper guidance, a first printing tower moistens the paper web and completely imprints it 4/4, while the second printing tower is switched off, and that, in a second operating mode, only the second printing tower imprints the paper web 4/4, and that because of this, considerable differences result in the running path of the moistened paper web between the two operating modes. In one case, for example, long running paths must be initially traveled dry upstream of the first printing group, while, in the other case, short and dry paths must initially be traveled, but downstream of the last printing group, long moist paths must be traveled.

The improvement of the print quality, in accordance with the present invention, is achieved because in every one of the operating modes of the imprinter operation, for example during flying plate changes, at least one of the printing groups of each printing unit, or of each printing tower, is engaged.

Besides the effects of moistening, by the operation of moistening devices, other effects, such as, for example, the presence of stretching marks, the occurrence of transverse and/or linear stretching as a result of printing, the effects caused by the application of ink, or the effects of other parameters affecting the tension and conveyance, can be smoothed out.

It is therefore particularly advantageous that, for all operating modes during imprinter operations, as even as possible conditions over the entire paper travel, and therefore also as identical as possible tension conditions, can be produced in the paper web. At the same time, the danger of a web break during "switching" is greatly reduced.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
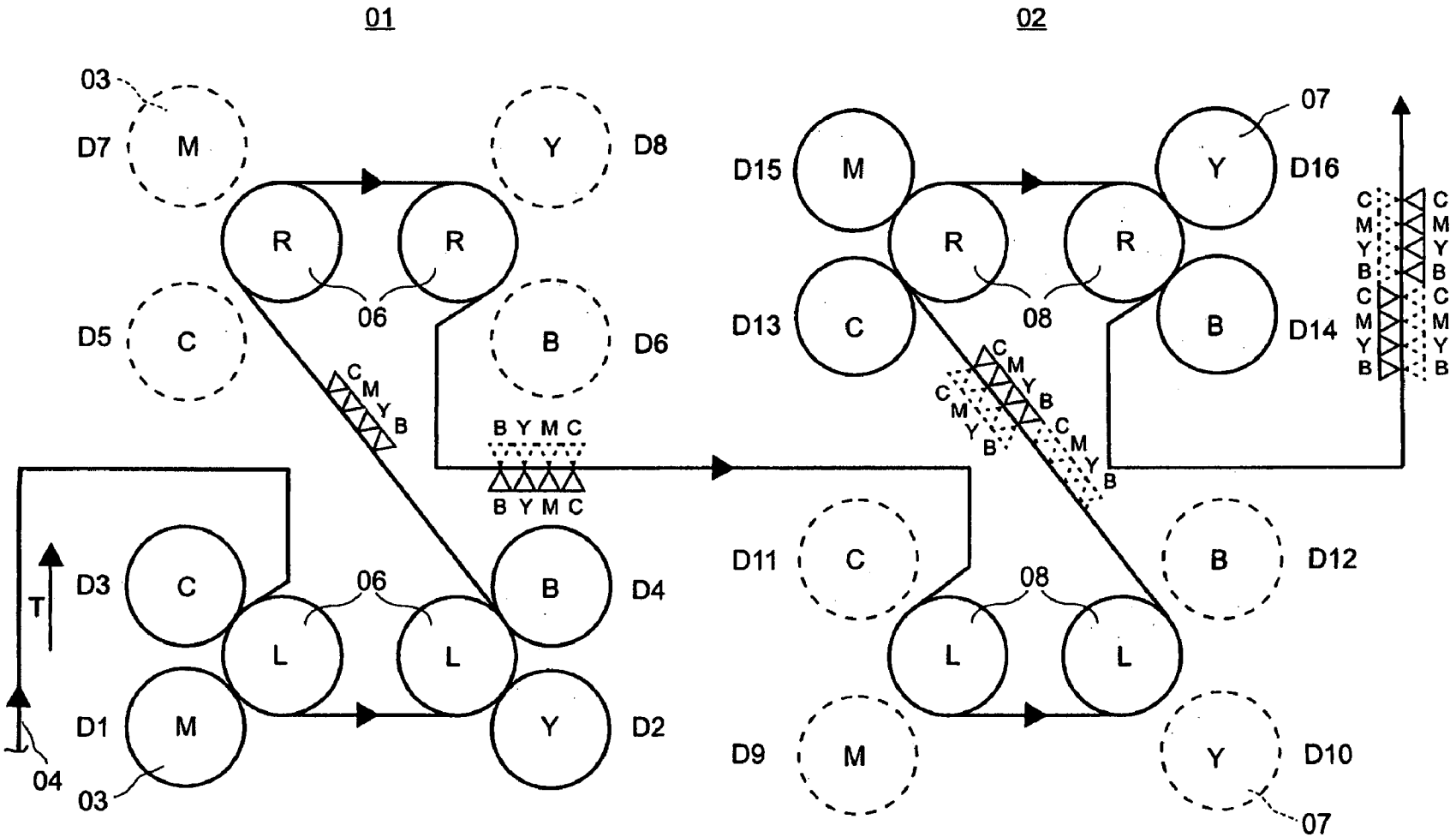
FIG. 1, printing units of a web-fed rotary printing press in satellite construction with complete imprinter functionality during four-color printing, in FIG. 2, printing units of a web-fed rotary printing press during rubber-against-rubber printing with complete imprinter functionality during four-color printing, and in FIGS. 3*a*–3*d*, variations in printing units with horizontal web guidance.

Referring initially to FIG. 1, a printing press, and in particular a web-fed rotary printing press, has a first unit 01, for example a first printing unit 01 or a first printing tower 01, and a second, further unit 02, for example a second printing unit 02 or a second printing tower 02. The first printing unit or tower 01 has at least six printing positions. In the first preferred embodiment of the present invention, as shown in FIG. 1 the first printing unit 01 has eight printing positions D1, D2, D3, D4, D5, D6, D7, D8, which are constituted by eight cylinders 03, for example by eight transfer cylinders 03, and by satellite cylinders 06, for example steel cylinders 06, which satellite or steel cylinders 06 act together with the eight transfer cylinders 03, in a print-on position of each, via a drawn-in web 04, for example an imprinting material 04, and, in particular a paper web 04. The second printing unit or tower 02 also has at least six, and in this first preferred embodiment has eight printing positions D9, D10, D11, D12, D13, D14, D15, D16, which are constituted by eight cylinders 07, for example by eight transfer cylinders 07, and by satellite cylinders 08, for example steel cylinders 08, which satellite or steel cylinders 08 act together with the eight transfer cylinders 07 in the print-on position via the web 04.

If the web 04 is to be imprinted in four colors (4/4), each of the printing units 01, 02 must be embodied with eight printing positions D1, D2, D3, D4, D5, D6, D7, D8, or D9, D10, D11, D12, D13, D14, D15, D16, respectively for full imprinter capability.

In the first preferred embodiment, which is depicted in FIG. 1, for four-color printing with full imprinter functionality, respectively two adjoining transfer cylinders 03, 07 of the first and second printing units 01, 02, respectively each act together with one of the respectively four steel cylinders 06, 08, and together constitute the eight printing positions D1, D2, D3, D4, D5, D6, D7, D8, or D9, D10, D11, D12, D13, D14, D15, D16. For example, this can be accomplished using a pair of stacked ten-cylinder satellite printing units. However, four upper and/or four lower transfer cylinders 03, 07, each with a single satellite cylinder 06, 08 in the form of so-called nine-cylinder units, can also act together and can be stacked, for example. The at least two, or for example, the four transfer cylinders 03, 07, constitute a group of printing positions. In the same way, the four lower or the four upper transfer cylinders 03, 07, each acting together with two satellite cylinders 06, 08, can also constitute a group of printing positions.

The transfer cylinders 03, 07 can be selectively placed in contact with, or against or can be moved away from the respective satellite cylinders 06, 08, and can act together with forme cylinders, which are not specifically represented, which forme cylinders, in turn, act together with also not specifically represented inking units and, if required, also with moistening units.

During imprinter operations, at least the not depicted forme cylinder can be moved away from its corresponding transfer cylinder 03, or 07 and can be operated at rpm which are different from at least the rpm of the respective satellite cylinder 06, or 08 so that, for example for changing the printing forme or the printed image, the forme cylinder can be braked, stopped, if necessary operated in the reverse direction, and/or operated at rpm different from the production rpm, independently of the satellite cylinder 06, or 08. During the changing of the printing forme or the printed image, for example illustration, the satellite cylinder 06, or 08 and, if required the transfer cylinder 03, or 07, can continue to be operated at the production rpm.

In the first printing unit or tower 01, the web 04 passes through the eight printing positions D1, D2, D3, D4, D5, D6, D7, D8 in the customary S-shaped manner, as seen in FIG. 1. The web 04 loops around the satellite cylinders 06 of the lower printing positions D1, D2, D3, D4 in a first direction of rotation, in respect to a conveying direction T of the web 04, L in the example in a counterclockwise direction, and through the upper printing locations D5, D6, D7, D8 in the opposite, or in a second direction of rotation which is different from the first direction of rotation, R in the example in a clockwise direction. In this way, the web 04 can theoretically be printed in four colors on both of its sides in the first printing tower 01 in the customary way if all eight of the printing positions D1 to D8 were engaged.

However, the web then passes, in the same or similar S-shaped manner, through the second printing tower 02 which, in an advantageous embodiment, is constructed with the same sequence of its printing positions D9 to D16. In particular, a construction which is identical with the first printing tower, requires the least outlay in regard to structure, logistics and control technology for the conversion from "normal" to imprinter operations.

However, in contrast to multi-color, imprinter-capable printing presses of the prior art, in the present invention not all of the printing positions D1 to D8 and D9 to D16 of the respective first and second printing units or towers 01, 02 are simultaneously engaged or disengaged in one operating mode. Instead, at least one printing position D1 to D8 of the first printing unit or tower 01 and at least one printing position D9 to D16 of the second printing unit or tower 02 is active, in a print-on position, in every operating mode.

If, in a preferred embodiment, as seen in FIG. 1, the assignment of colors to the printing positions D1 to D8 of the first printing unit or tower 01 and to the printing positions D9–D16 of the second printing unit or tower 02 are identical, and in particular are identical with regard to a customary color coating of a printing tower for "normal operations", i.e. for 4/4 printing, wherein the web 04 merely passes through one printing unit or tower 01, 02, conventional printing towers 01, 02 with a conventional assignment of the directions of rotation and of the colors can be employed. The path of the web can also be retained in the area of the printing towers 01, 02.

Thus, for example, the lower printing positions D1 to D4, or D9 to D12 of both printing units or towers 01, 02, respectively are equipped with cyan C, magenta M, yellow Y and black B in sequence along the running direction of the web 04. An embodiment is advantageous in which the upper printing positions D5 to D8, or D13, to D16 along the running direction of the web 04 have the same color sequence as the lower ones. In this way, with an S-shaped path of the web 04, the arrangement is mirrored about a non-represented horizontal center plane of each printing unit or tower 01, 02.

In a first operating mode, as shown in FIG. 1, the lower printing positions D1 to D4 of the first printing unit or tower 01, and the upper printing positions D13 to D16 of the second printing unit or tower 02, which is second in the running direction of the web 04, are engaged and imprint the web 04 on both sides during imprinter operations. In the second operating mode, the above-mentioned lower printing positions D1 to D4 and upper D13 to D16 are disengaged, for example for set-up. In this second operating mode, printing takes place using the upper printing positions D5 to D8 of the first printing unit or tower 01 and using the lower printing positions D9 to D12 of the second printing unit or tower 02.

The sequence of colors within the printing positions, assigned directly one behind the other to the same side of the web 04, can also be selected in any other way. The mirror-reversed arrangement of the lower and upper printing positions D1 to D16 in the respective printing units or towers 01, 02 is also not mandatory. However, it is essential that at least one printing position D1 to D8 of the first printing unit or tower 01, and one printing position D9 to D16 of the second printing unit or tower 02 is always activated, i.e. is in a print-on position, in each of the operating modes during imprinter operations.

If the printing press is to be changed from "normal operations" to imprinter operations, the web 04 is initially drawn in through both of the printing units or towers 01, 02. The printing positions D1 to D4 of the first printing unit or tower 01 and the printing positions D13 to D16 of the second printing unit or tower 02 are set up with printing formes, inks, etc. in accordance with the production in the first operating mode. Now, the printing positions D1 to D4 of the first printing unit or tower 01 and the printing positions D13 to D16 of the second printing unit or tower 02 are engaged for starting the printing process and are operated in production mode, while the printing positions D5 to D8 of the first printing unit or tower 01 and the printing positions D9 to D12 of the second printing unit or tower 02 are available for set-up.

For changing production, the printing positions D1 to D4 of the first printing unit or tower 01 and the printing positions D13 to D16 of the second printing unit or tower 02 are disengaged, and the printing positions D5 to D8 of the first printing unit or tower 01 and the printing positions D9 to D12 of the second printing unit or tower 02, now provided with new printing formes, are engaged.

Figure 2:
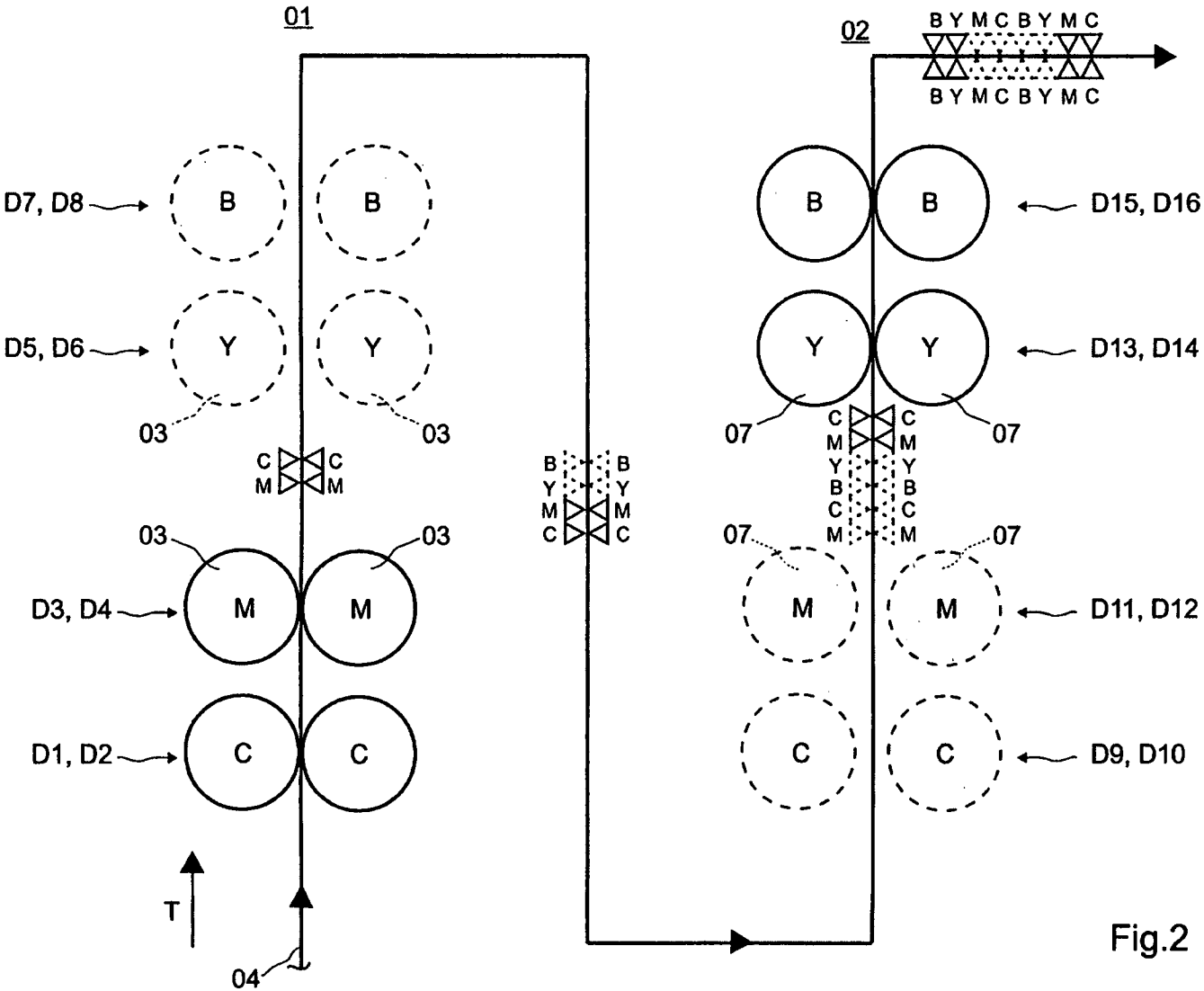

In a second preferred embodiment of the present invention, as shown in FIG. 2, the printing positions D1 to D16 are not configured for constituting printing positions D1 to D16 in cooperation with satellite cylinders 06, 07, but instead are configured to form pairs of double printing positions D1 and D2 to D15 and D16, respectively, which are identified in what follows as double printing positions D1, D2 and D3, D4, in rubber-against-rubber printing. These respectively constitute groups of at least two printing positions D1 to D16.

The first printing unit 01 and the second printing unit 02 each has at least two such double printing positions D1, D2 to D15, D16 respectively, which are each located in a common frame, for example. In one embodiment, the first double printing position D1, D2, together with the two, non-represented forme cylinder, is embodied as an n-shaped profile, and the second double printing position D3, D4, with its forme cylinders, is embodied as a u-shaped profile. However, the double printing positions D1 and D2 to D15 and D16 can all be embodied as "n-shaped", as linear, or as "u-shaped" profiles.

In the preferred embodiment in accordance with FIG. 2, the first printing unit 01 has four such double printing positions D1, D2; D3, D4; D5, D6; D7, D8, of which the two lower printing positions, and the two upper printing positions are each arranged in one frame. However, all of the double printing positions D1, D2; D3, D4; D5, D6; D7, D8 can each be arranged in their own frames, or all of the double printing positions can be arranged in a common frame. The two lower double printing positions, and the two upper double printing positions D1, D2; D3, D4; D5, D6; D7, D8; and D9, D10; D11, D12; D13, D14 and D15, D16, respectively each constitute here a group of printing positions D1, D2; D3, D4; D5, D6; D7, D8; D9, D10; D11, D12; D13, D14 and D15, D16.

For multi-color imprinter operations, the web 04 is conducted through the second printing unit 02 having the same structure of the double printing positions D9, D10; D11, D12; D13, D14 and D15, D16. The double printing positions D1, D2; D3, D4; D5, D6; D7, D8; D9, D10; D11, D12; D13, D14 and D15, D16, intended for flying printing forme change or for imprinter operation, each can be disengaged, so that a web 04 running at production speed can be conducted, in a contact-free manner, through the disengaged double printing positions D1, D2; D3, D4; D5, D6; D7, D8; D9, D10; D11, D12; D13, D14 and D15, D16.

For imprinter operations, at least one of the double printing positions D1, D2; D3, D4; D5, D6; D7, D8; or D9, D10; D11, D12; D13, D14; D15, D16 is activated, i.e. engaged, in all operating modes, the same as was the case in the first preferred embodiment.

In an advantageous embodiment, the sequence of colors for the double printing positions D1, D2; D3, D4; D5, D6; D7, D8; or D9, D10; D11, D12; D13, D14; D15, D16, in the first and in the second printing units or towers 01, 02, is identical, as was the case in the first preferred embodiment, so that, in addition to imprinter operations, so-called "normal operations", for 4/4 printing, are possible in each of the two printing units or towers 01, 02, each with vertical, upward extending guidance of the web 04.

In the first operating mode, for example, the two lower double printing positions D1, D2 and D3, D4 of the first printing unit or tower 01, as well as the two upper double printing positions D13, 14 and D15, D16 of the second printing unit or tower 02 are engaged during imprinter operations, while the remaining double printing positions D5, D6; D7, D8, as well as D9, D10 and D11, D12 are disengaged. In the second operating mode the conditions are reversed. The web 04 is, in the second operating mode, conducted downward after the first printing unit or tower 01, and upward in the second printing unit or tower 02.

In another preferred embodiment, which is advantageous in respect to evening out, after passing through the first printing unit or tower 01, the web 04 is conducted from above through the second printing unit or tower 02.

Also, in an effort to attain as even as possible moistening, in both operating modes, over the course of the web 04, it is possible to provide different sequences of colors in the first and second printing units or towers 01, 02.

FIGS. 3*a*–3*d* represent a third preferred embodiment regarding printing positions D1, D2, D3, D4, D5, D6, D7, D8, D9, D10, D11, D12, D13, D14 and D15, D16, or double printing positions D1, D2; D3, D4; D5, D6; D7, D8; D9, D10; D11, D12; D13, D14 and D15, D16, through which the web 04 passes horizontally. The first four double printing positions D1, D2; D3, D4; D5, D6; D7, D8, as well as the second four double printing positions D9, D10; D11, D12; D13, D14; D15, D16, are each embodied as printing units 01, 02 for four-color printing on both sides. During normal printing operations, a web 04 can pass through each of these to be imprinted in four colors on both sides.

However, in the operating mode of the printing units, for a flying plate change, a web 04 passes through both printing units 01, 02, or through printing positions D1, D2, D3, D4, D5, D6, D7, D8, D9, D10, D11, D12, D13, D14, D15, D16 of both printing units 01, 02, wherein at least one double printing position D1, D2; D3, D4; D5, D6; D7, D8; D9, D10; D11, D12; D13, D14; D15, D16, as a group, for each printing unit 01, 02 is engaged and imprints the web 04.

Thus, for example, the black B, the magenta M and the yellow Y double printing positions D1, D2; D5, D6; D7, D8 of the first printing unit 01, and the cyan C double printing position D11, D12 of the second printing unit 02 which are represented filled out, print in a first operating mode depicted in FIG. 3*a*. In the remaining double printing positions a plate change can take place. In the second operating mode, shown in FIG. 3*b*, the conditions are reversed.

Figure 3A:
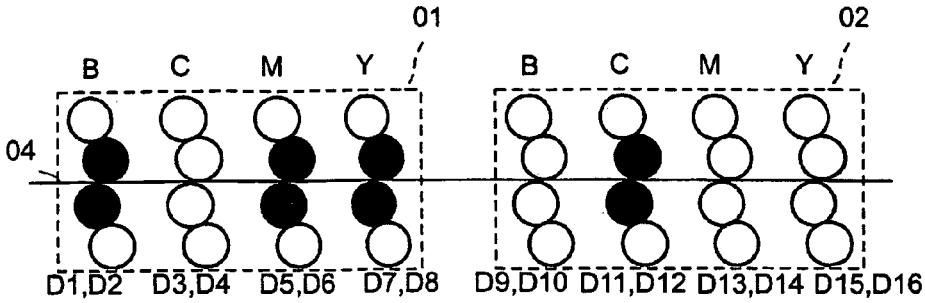
Figure 3B:
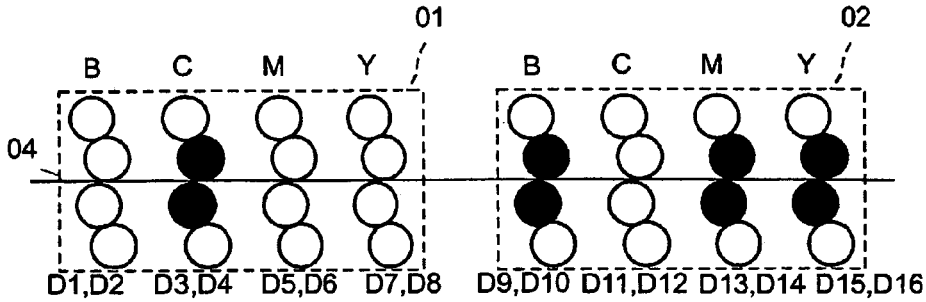
Figure 3C:
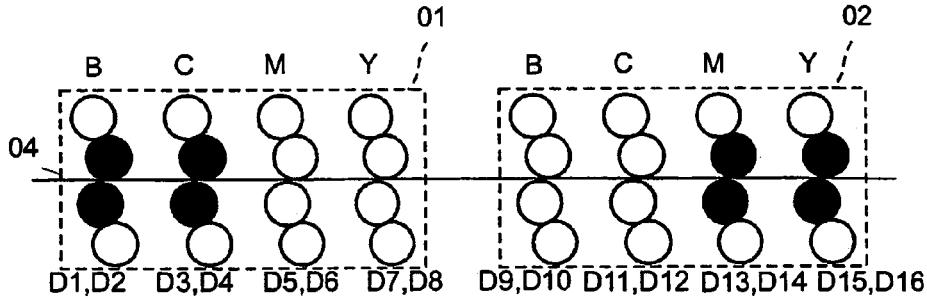
Figure 3D:
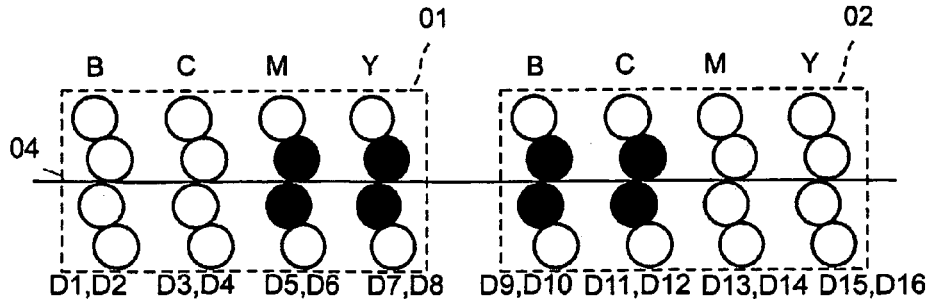

In the variations represented in FIGS. 3*c* and in 3*d*, the first two double printing positions D1, D2; D3, D4 of the first printing unit 01, and the last two double printing positions D13, D14; D15, D16 of the second printing unit 02 are in a print-on position in a first operating mode shown in FIG. 3*c*, while the remaining ones are available for a flying plate change. In the second operating mode, which is shown in FIG. 3*d*, the conditions are again reversed.

The arrangements and the operating modes for imprinter operation from the preferred embodiments can also be transferred to printing presses embodied for fewer than four colors, which printing presses therefore have fewer double printing positions. Thus, for example, it is possible, in a preferred embodiment, which is not specifically represented, to imprint a web 04 on two sides with two colors during imprinter operation by the use of two units embodied with double printing positions, wherein during "normal operations" two webs 04 can be imprinted on two sides with two colors.

If the printing positions D1 to D16, or the double printing positions D1, D2 to D15, D16 are structurally arranged in different frames from each other, so that a path of the web 04 between the structurally separately arranged printing positions in, for example, the two separate printing units 01, 02, or printing towers 01, 02, is increased, with respect to the paths within a printing unit 01, 02, it is particularly advantageous, in each one of the two operating modes, to engage respectively one printing position of each printing unit 01, 02, or of each printing tower 01, 02.

The expression printing unit should therefore also be understood as a structural unit, which has printing units which are arranged directly above each other or side-by-side, for example bridge printing units or H-printing units, whose cylinders, however, need not necessarily be arranged within the same frame.

While preferred embodiments of a web-fed rotary printing press, in accordance with the present invention, have been set forth fully and completely hereinabove, it will be apparent to one of skill in the art that various changes in, for example, the specific sizes of the cylinders, the drives for the cylinders, and the like could be made without departing from the true spirit and scope of the subject invention which is accordingly to be limited only by the following claims.

What is claimed is:

1. A web-fed rotary printing press adapted for use in printing both sides of a web in a group of multiple colors in imprinter operation comprising:

at least a first printing tower and a second printing tower, said at least first and second printing towers cooperating with each other to print both sides of a single web in said group of multiple colors as that single web passes sequentially through both of said first and second cooperating printing towers in said web-fed rotary printing press;

at least four first printing positions in said first printing tower, each of said four first printing positions being selectively usable to print a separate one of said group of multiple colors on said single web during passage of said single web through said first printing tower;

at least four second printing positions in said second printing tower, each of said four second printing positions being selectively usable to print said separate one of said group of multiple colors on said web during passage of said web through said second printing tower;

a first multiple color web printing group formed by first selected ones of said at least four first separate color printing positions in said first printing tower and by first selected other ones of said at least four second separate color printing positions in said second printing tower;

a second multiple color web printing group formed by second selected ones of said at least four first separate color printing positions in said first printing tower and by second selected other ones of said at least four second separate color printing positions in said second printing tower;

a first imprinter operating mode of said web-fed rotary printing press, said first imprinter operating mode being usable to apply said group of multiple colors to said web by passage of said web through said first multiple color printing group in said first and second cooperating printing towers, and;

a second imprinter operating mode of said web-fed rotary printing press, said second imprinter operating mode being usable to apply said group of multiple colors to said web by passage of said web through said second multiple color printing group in said first and second cooperating printing towers, said first multiple color printing group printing positions in said first and second towers being different from said second multiple color printing group printing positions in said first and second printing towers, at least one of said at least four first printing positions in said first printing tower and at least one of said at least four second printing positions in said second printing tower being in a print-on position in each of said first and second imprinter operating modes.

2. The web-fed rotary printing press of claim 1 wherein there are at least six of said printing positions in each of said first and second printing towers.

3. The web-fed rotary printing press of claim 1 wherein said at least first and second printing towers are horizontally offset from each other.

4. The web-fed rotary printing press of claim 1 wherein said web is conducted vertically between said at least first and second groups of said printing positions in each of said at least first and second printing towers.

5. The web-fed rotary printing press of claim 1 wherein said web is conducted horizontally between said at least first and second groups of said printing positions in each of said at least first and second printing towers.

6. The web-fed rotary printing press of claim 1 further including two print cylinders acting together with at least one satellite cylinders in each of said at least four first and second printing positions in said first and second printing towers.

7. The web-fed rotary printing press of claim 1 wherein each one of said first and second printing towers includes first and second satellite printing units arranged on top of each other.

8. The web-fed rotary printing press of claim 7 wherein, in said first operating mode, only printing positions from one of said first and second satellite printing units, and in said second operating mode only printing positions from the other of said first and second said satellite printing units of the same printing tower are in the print-on position.

9. The web-fed rotary printing press of claim 1 wherein said first and second groups of said printing positions are each double printing positions that are adapted for printing in rubber against rubber operation by two cylinders working together with each other through the web.

10. The web-fed rotary printing press of claim 1 wherein each said printing tower has four double printing positions in rubber against rubber operation.

11. The web-fed rotary printing press of claim 9 wherein each of said at least first and second printing towers has four of said double printing units arranged horizontally side by side.

12. The web-fed rotary printing press of claim 10 wherein, in each of said first and second operating modes selectively only one of lower and upper ones of said double printing positions of each of said first and second printing towers are in the print-on position.

13. The web-fed rotary printing press of claim 1 wherein each of said first and second printing towers has first and second H-printing units arranged on top of each other for rubber against rubber operation.

14. The web-fed rotary printing press of claim 13 wherein in said first operating mode only the printing positions of one of said H-printing units, and in said second operating mode, only the printing positions of the other of said H-printing units, in each of said first and second printing towers are in the print-on position.

15. The web-fed rotary printing press of claim 1 further including first applying the colors to a first side of a web and then applying the same colors to a second side of the web.

16. The web-fed rotary printing press of claim 1 wherein, in at least one mode of imprinter operation, at least one of said printing positions, which is in a print-on position is arranged intermediate others of said printing positions, along a path of web travel, which are in a print-off position, for at least one of said first and second printing groups.

17. The web-fed rotary printing press of claim 1 wherein each of said at least first and second printing towers is adapted for four color printing on both sides of a web.

* * * * *